United States Patent [19]

Ogawa

[11] Patent Number: 5,003,899

[45] Date of Patent: Apr. 2, 1991

[54] APPARATUS FOR DISCONNECTING A NEEDLE BAR AND THREADING ON A SEWING MACHINE

[75] Inventor: Masao Ogawa, Nagoya, Japan

[73] Assignee: Brother Kogyo Kabushiki Kaisha, Nagoya, Japan

[21] Appl. No.: 583,323

[22] Filed: Sep. 17, 1990

[30] Foreign Application Priority Data

Oct. 14, 1989 [JP] Japan ..... 1-267859

[51] Int. Cl.[5] ..... D05B 55/16; D05B 87/02

[52] U.S. Cl. ..... 112/221; 112/225

[58] Field of Search ..... 112/221, 220, 78, 84, 112/98, 163, 224, 225

[56] References Cited

U.S. PATENT DOCUMENTS

| | | | |
|---|---|---|---|
| 4,098,207 | 7/1978 | Peterson | 112/221 |
| 4,325,313 | 4/1982 | Kawai et al. | 112/221 X |
| 4,651,660 | 3/1987 | Oshima et al. | 112/225 |

*Primary Examiner*—Peter Nerbun

*Attorney, Agent, or Firm*—Oliff & Berridge

[57] ABSTRACT

In a device for disconnecting a needle bar from a needle-bar connecting stud on a sewing machine, a drive source drives a moving board. The moving board lowers a predetermined distance until a threading hook goes through an eye in a needle. A disconnecting member rotates a clutch click and disconnects the clutch click from a needle-bar connecting stud. The needle bar thus disengages from the needle-bar connecting stud. The moving board further lowers, an actuating rod lowers, the actuating rod in turn lowers a threading rod, the threading rod further rotates, and the threading hook goes through the eye. The needle is thus threaded. The disconnecting operation and the threading operation are carried out by using the drive source in common. Consequently, the device is simple in structure and compact in size. Since the needle bar only rises to disengage from the needle-bar connecting stud, no scratches are given on the fabric. The sewing machine can effectively execute pattern-sewing, basting and other operations.

25 Claims, 6 Drawing Sheets

APPARATUS FOR DISCONNECTING A NEEDLE BAR AND THREADING ON A SEWING MACHINE

BACKGROUND OF THE INVENTION

This invention relates to a needle-bar disconnecting device on a sewing machine for connecting and disconnecting a needle bar to and from a needle-bar connecting stud moving vertically synchronously with the rotation of an arm shaft.

When fabric is embroidered, basted, or sewn, the movement of the needle bar is stopped temporarily and fabric is fed without being sewn. For that purpose, a device for stopping the movement of the needle bar is used. A device for stopping the rotation of an arm shaft is known. A device for stopping a counterbalancing crank with a clutch provided between the arm shaft and the counterbalancing crank is also known. However, the inertia of stopped components of these known devices is so large that at the time of restart a large load is applied to the clutch and other components. To solve this problem, Japan Published Examined Utility Model Application No. S61-25752 and Japan Published Unexamined Patent Application No. S59-194792 are proposed. In these related-art references, a clutch is provided between a needle-bar connecting stud and a needle bar, and only the needle bar is stopped. Another related-art device proposed in Japan Published Unexamined Utility Model Application No. S62-139472 is applied to a zigzag sewing machine. In this device a needle bar is rotated in a width larger than that of a zigzag form sewn. The rotation of the needle bar actuates a clutch for disconnecting the needle bar from a needle bar connecting stud.

Further, threading the needle of a sewing machine presents related problems. To facilitate threading, various threading devices are proposed. For example, in Japan Published Unexamined Patent Application No. H1-113092, a spring exerts an upward force on an actuating rod. The actuating rod is lowered by an air cylinder. A threading rod interlocks with the actuating rod, lowers, and rotates. A threading hook thus goes through an eye in a needle and catches a thread. Subsequently, when the threading hook is drawn from the eye, thread is also drawn and the needle is threaded.

In the related art, some sewing machines are provided with both the needle-bar disconnecting device and the threading device. However, when these related-art devices are both used in a sewing machine, a drive source for actuating the clutch and disconnecting the needle bar must be mounted separately from the drive source required for threading. Therefore, the devices occupy excessive space in the sewing machine. At the same time, since the devices must be controlled separately, a complicated control device is required.

The needle bar is disconnected from the needle-bar connecting stud through a pulse motor, and the pulse motor can also be used for the rotating of the needle bar. However, every time the needle bar disengages from the needle-bar connecting stud, the needle bar laterally moves. The resulting problem is that the relative position among a thread guide, an eye in a needle, and stitches causes variances in thread amount and tension. At the same time, the lateral movement of the needle bar may mar the fabric.

SUMMARY OF THE INVENTION

The object of this invention is to provide a device with a simple structure that can securely disconnect a needle bar from a needle-bar connecting stud and thread a needle.

To attain this and other objects, this invention provides a device for disconnecting a needle bar from a needle-bar connecting stud and threading a needle on a sewing machine. The sewing machine comprises a needle, a vertically moving needle bar having the needle on its lower end, a spring for exerting an upward force on the needle bar, a rotating arm shaft, a needle-bar connecting stud being driven through the arm shaft for moving vertically along the needle bar, and a clutch click provided on the needle bar for rotating and engaging in the needle-bar connecting stud. The clutch click engages in the needle-bar connecting stud, and the needle-bar connecting stud together with the needle bar moves vertically to sew. The sewing machine further comprises an actuating rod for vertically moving in parallel with the needle bar, a moving board for vertically moving in parallel with the actuating pin, a drive source for moving the moving board and lowering the actuating rod, and a disconnecting means for rotating the clutch click and disconnecting the needle bar from the needle-bar connecting stud. The drive source drives the moving board, the actuating rod lowers and the threading hook enters the eye to thread the needle. The moving board moves by the predetermined distance until the threading hook goes through the eye, and the clutch click rotates and disengages from the needle-bar connecting stud.

DETAILED DESCRIPTION OF THE PREFERRED EMBODIMENT

Figure 1:
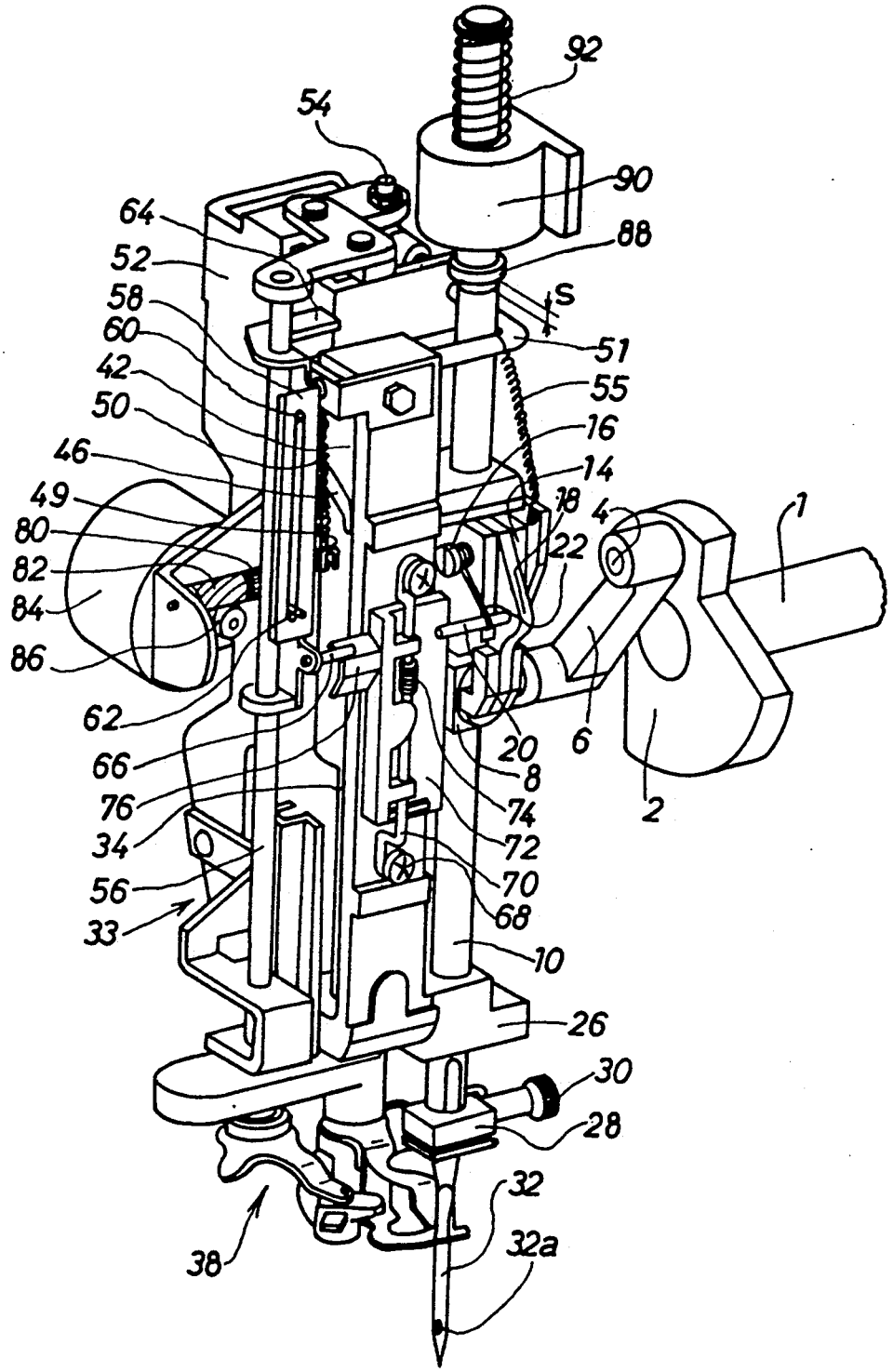
FIG. 1 is a perspective view of a needle-bar disconnecting device on a sewing machine for an embodiment of this invention.
Figure 3:
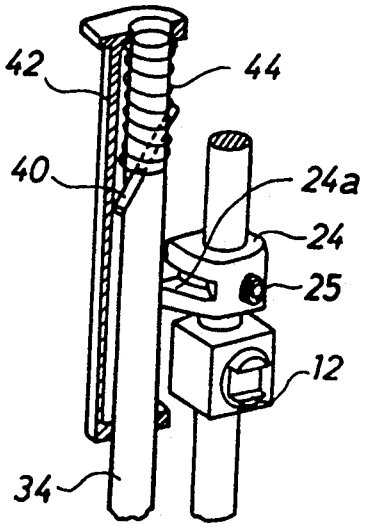
FIG. 3 is a partial perspective view of a positioning stopper and its adjoining components for the embodiment.

As shown in FIG. 1, a device for disconnecting a needle bar on a sewing machine is connected to an arm shaft 1. The arm shaft 1 is driven and rotated through a sewing-machine motor (not shown). A crankpin 4 is set on a counterbalance 2 on the arm shaft 1. One end of a connecting rod 6 is rotatably inserted into the crankpin 4, and a needle-bar connecting stud 8 is rotatably inserted into the other end of the connecting rod 6. The needle-bar connecting stud 8 is slidably engaged on a needle bar 10. As shown in FIG. 3, a groove 12 radially and horizontally extends in the needle-bar connecting stud 8.

A needle bar frame 14 is attached to the needle bar 10. A stud 16 is inserted into the needle bar frame 14 and slidably supports a click 18 in the needle bar frame 14. One end of a torsion spring 22 is attached to the stud 16, and the other end of the torsion spring 22 is engaged on a clutch pin 20 inserted into the click 18 perpendicularly to the needle bar 10. The torsion spring 22 applies a force to the click 18 so that the end of the click 18 engages the groove 12 in the needle-bar connecting stud 8. The click 18 can be engaged to and disengaged from the groove 12 through the torsion spring 22. As shown in FIG. 3, a positioning stopper 24 is secured through a screw 25 onto the needle bar 10 at a predetermined position above the needle-bar connecting stud 8. A projection 24*a* projects from the positioning stopper 24 perpendicularly to the axial direction of the needle bar 10.

Figure 2:
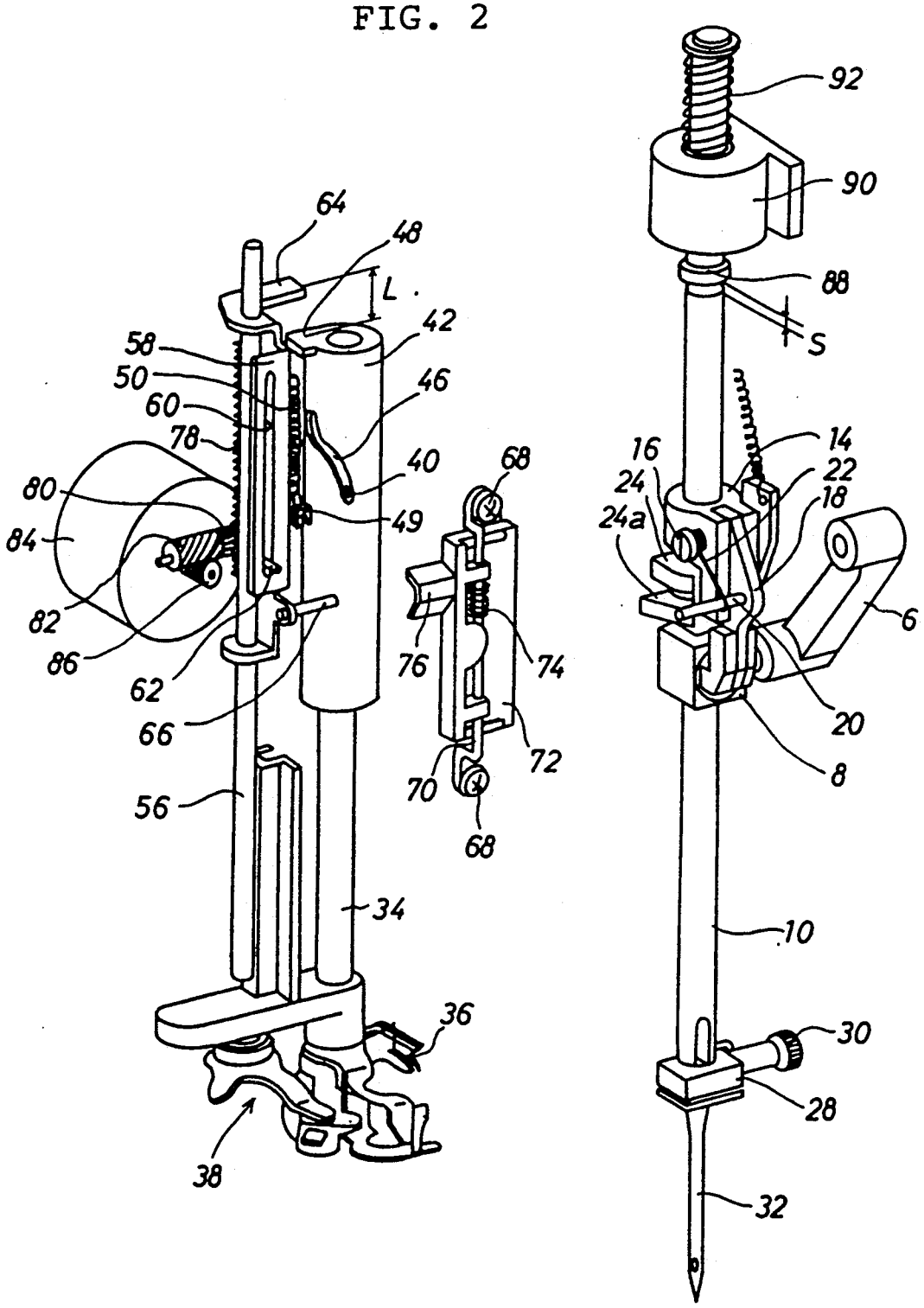
FIG. 2 is a perspective view of a disassembled main portion of the device shown in FIG. 1.

A needle bar support 26 supports the needle bar 10 such that the needle bar 10 can vertically slide. A needle 32 is attached through a needle connecting stud 28 and a clamp screw 30 to the lower end of the needle bar 10. A threading mechanism 33 adjoins the needle bar support 26. The threading mechanism 33 includes a threading rod 34 provided in parallel with the needle bar 10 on the needle bar support 26. The threading rod 34 can rotate about its axis and slide vertically. As shown in FIG. 2, the threading rod 34 has a threading hook 36 on its lower end. When the threading rod 34 rotates about its axis, the threading hook 36 is rotated through a known linkage 38 toward an eye 32*a* in the needle 32.

As shown in FIG. 3, an actuating pin 40 is inserted and secured in its axial direction through the upper part of the threading rod 34. When the threading rod 34 lowers, the actuating pin 40 lowers and contacts the projection 24*a* of the positioning stopper 24. The positioning stopper 24 is secured through the screw 25 to the predetermined position of the needle bar 10 so that when the actuating pin 40 contacts the projection 24*a*, the threading hook 36 is lowered to the eye 32*a* in the needle 32.

As shown in FIG. 3, an actuating rod 42 is slidably inserted onto the threading rod 34, and a compression spring 44 is interposed between the actuating pin 40 and the actuating rod 42. As shown in FIG. 2, an S-shaped guide slot 46 extends upward in the outer periphery of the actuating rod 42. One end of the actuating pin 40 engages the guide slot 46. A contact surface 48 is formed on the upper end of the actuating rod 42 and projects along the radius of the threading rod 34. A hook 49 is formed on the outer periphery of the actuating rod 42. A spring 50 extends between the hook 49 and a hook (not shown) formed as one piece with the needle bar support 26. The spring 50 exerts an upward force on the actuating rod 42.

As shown in FIG. 1, one end of an L-shaped member 51 is rotatably inserted to the upper end of the needle bar support 26. The other end of the L-shaped member 51 is rotatably attached through a screw 54 into a threading housing 52 secured to a sewing-machine housing (not shown). A spring 55 extends between the L-shaped member 51 and the needle bar frame 14, and exerts an upward force through the needle bar frame 14 to the needle bar 10.

A guide bar 56 is secured onto the threading housing 52 in parallel with the threading rod 34. A moving board 58 is slidably attached to the guide bar 56, separately from the actuating rod 42. The moving board 58 includes a slot 60 extending along the sliding direction of the moving board 58. A pin 62 on the guide bar 56 engages the slot 60, thus preventing the moving board 58 from rotating. A projection 64 is formed on the upper end of the moving board 58. When the moving board 58 slides down toward the actuating rod 42, the projection 64 can touch the contact surface 48 of the actuating rod 42. When the moving board 58 is in its uppermost position as shown in FIG. 2, the projection 64 is a predetermined distance L away from the contact surface 48. However, the projection 64 can be in contact with the contact surface 48. The actuating rod 42 can be formed as one piece with the moving board 58.

A disconnecting pin 66 is provided in parallel with the pin 20 on the lower end of the moving board 58. A rotating shaft 70 is secured through two screws 68 in parallel with the guide bar 56 onto the needle bar support 26. A disconnecting board 72, which is supported on the rotating shaft 70, can rotate. A torsion spring 74 wound around the rotating shaft 70 puts the disconnecting board 72 in parallel with the axis of the pin 20 and that of the disconnecting pin 66. A ridge 76, which is formed on the disconnecting board 72, slopes away from the disconnecting pin 66. When the moving board 58 and the disconnecting pin 66 rotate and lower, the disconnecting pin 66 presses down the ridge 76 and the disconnecting board 72 is rotated. While the needle bar 10 is vertically moving, the disconnecting board 72 can rotate and contact the clutch pin 20, thereby pressing up the clutch pin 20. The clutch pin 20 disconnects the click 18 from the groove 12.

The moving board 58 includes a rack 78. The teeth of the rack 78 are formed transverse to the sliding direction of the moving board 58. The rack 78 meshes with a pinion 80. The pinion 80 and a helical gear 82 form one member and are rotatably supported on the threading housing 52. A worm gear 86 is attached to a rotating shaft of a pulse motor 84 on the threading housing 52 and meshes with the helical gear 82. The pulse motor 84 composes a drive source for threading the needle 32.

On the other hand, a stopper 88 is a gap S away from the upper end of the needle bar 10. When a solenoid 90 is energized, the stopper 88 can protrude toward the needle bar 10 against the force of a coil spring 92 and lower the needle bar 10.

Figure 5:
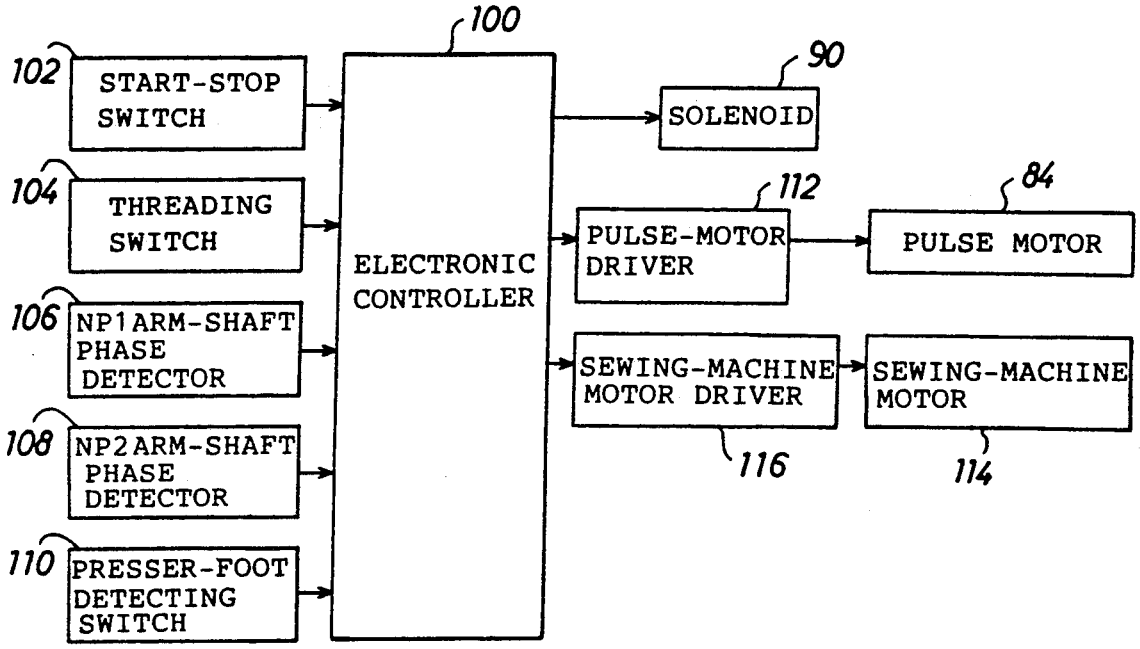
FIG. 5 is a schematic diagram of an electric structure for the embodiment.

As shown in the electric circuit schematic diagram in FIG. 5, an electronic controller 100 controls the threading mechanism 33. A start-stop switch 102 and a threading switch 104 are connected to the electronic controller 100. An NP1 arm-shaft phase detector 106, an NP2 arm-shaft phase detector 108, and a presser-foot detecting switch 110 are also connected to the electronic controller 100. When the arm shaft 1 rotates and the needle bar 10 rises to its uppermost position, the NP1 arm-shaft phase detector 106 detects the corresponding rotational position of the arm shaft 1 and sends out an NP1 signal. The NP2 arm-shaft phase detector 108 detects that the arm shaft 1 rotates by 30 degrees further from the rotational position detected by the NP1 arm-shaft phase detector 106 and sends out an NP2 signal. The presser-foot detecting switch 110 detects when a presser foot (not shown) lowers and sends out a signal. The electronic controller 100 transmits a control signal to the solenoid 90, a pulse-motor driver 112, and a sewing-machine motor driver 116. The pulse-motor driver 112 transmits pulses to the pulse motor 84 corresponding to the control signal from the electronic controller 100. The sewing-machine motor driver 116 transmits pulses to a sewing-machine motor 114 corresponding to the control signal from the electronic controller 100. The sewing-machine motor 114 drives and rotates the arm shaft 1.

Figure 6:
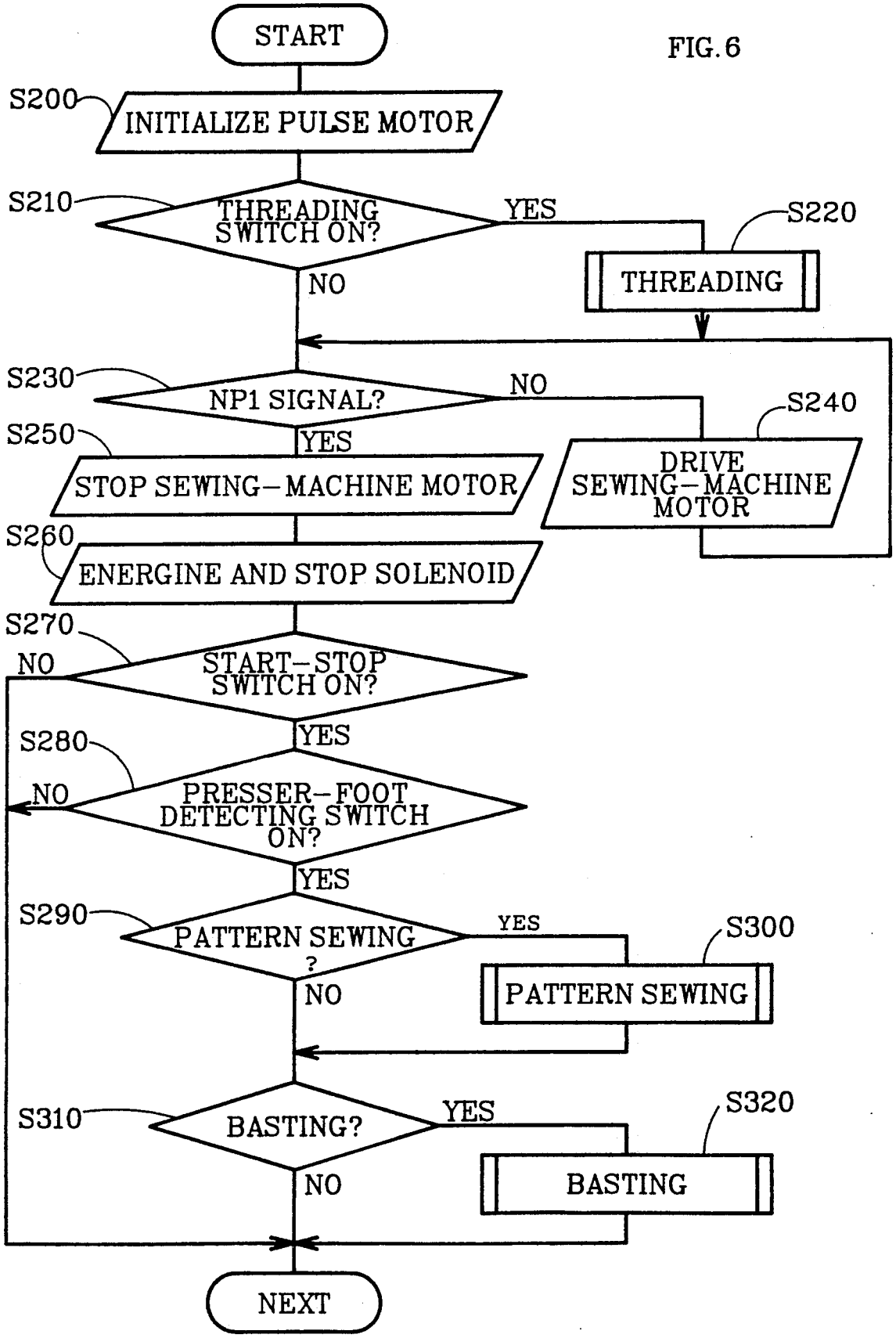
FIG. 6 is a flow chart of main control routine executed in a control circuit for the embodiment.

In operation, as shown in the flowchart of FIG. 6, after a power switch on the sewing machine is turned on, step S200 initializes the pulse motor 84. An operator presses the threading switch 104 so that the eye 32*a* in the needle 32 is threaded with thread 94 prior to sewing operation. When step S210 determines that the threading switch 104 is turned on, step S220 executes threading procedure.

Specifically, first the pulse motor 84 receives a drive signal with the predetermined pulses from the pulse-motor driver 112 and rotates. The rotation of the pulse motor 84 is transmitted through the worm gear 86, the helical gear 82, the pinion 80 and the rack 78 to the moving board 58, thereby lowering the moving board 58 along the guide bar 56.

The moving board 58 lowers the predetermined distance L, and the projection 64 of the moving board 58 contacts the contact surface 48 of the actuating rod 42 and presses down the actuating rod 42 against the force of the compression spring 50. At the same time, the compression spring 44 and the guide slot 46 lower. The actuating pin 40 lowers the threading rod 34. Therefore, the linkage 38 and the threading hook 36 also lower.

Figure 8:
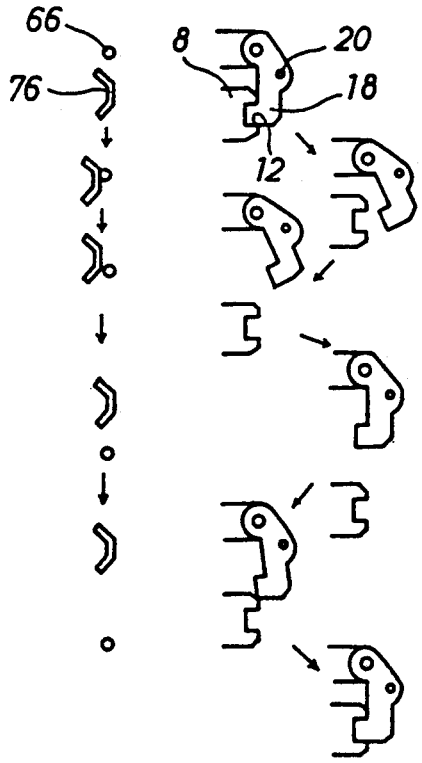
FIG. 8 illustrates the operation of a clutch click for the embodiment.

In this embodiment, when the moving board 58 lowers the predetermined distance L, as shown in FIG. 8, the disconnecting pin 66 presses down the ridge 76 of the disconnecting board 72 and the disconnecting board 72 rotates. Subsequently, since the pin 20 of the click 18 is raised, the click 18 is disconnected from the groove 12. The spring 55 exerts upward force on the needle bar 10, thereby raising the needle bar 10 until the upper end of the needle bar 10 touches the stopper 88. When the click 18 is disengaged from the groove 12, the needle bar 10 is higher by the gap S than its uppermost position to which the rotation of the arm shaft 1 brings the needle bar 10. Therefore, if the needle-bar connecting stud 8 returns to its uppermost position through the rotation of the arm shaft 1, the click 18 fails to engage in the groove 12. The predetermined gap S prevents the needle bar 10 from contacting the stopper 88 with noise every time the needle bar 10 rises at the time of the sewing operation. Consequently, the gap S should be more than zero.

On the other hand, when the needle bar 10 rises through the force of the spring 55, the NP1 arm-shaft phase detector 106 transmits the NP1 signal to the electronic controller 100, and the arm shaft 1 is stopped at the rotational position where the needle bar 10 is at its uppermost position.

When the threading rod 34 lowers, the actuating pin 40 lowers. The end of the actuating pin 40 contacts the projection 24*a* of the positioning stopper 24. On the other hand, the click 18 is disengaged from the groove 12 by means of the disconnecting board 72. The actuating pin 40 in contact with the projection 24*a* can lower the needle bar 10 against the force of the spring 55. When the needle bar 10 is lowered by the gap S, the click 18 engages in the groove 12 in the needle-bar connecting stud 8 stopped at its uppermost position. Since the arm shaft 1 is stopped, no rotation is transmitted through the connecting rod 6 to the needle-bar connecting stud 8. The needle bar 10 is thus held at its uppermost position, and the threading rod 34 fails to lower further. When the threading rod 34 is stopped, the pulse motor 84 lowers the moving board 58. The actuating rod 42 lowers against the force of the compression spring 44, and the actuating pin 40 moves along the guide slot 46, thereby rotating the threading rod 34. The rotation of the threading rod 34 is transmitted through the linkage 38 to the threading hook 36. The threading hook 36 rotates and enters the eye 32*a* in the needle 32.

Figure 4:
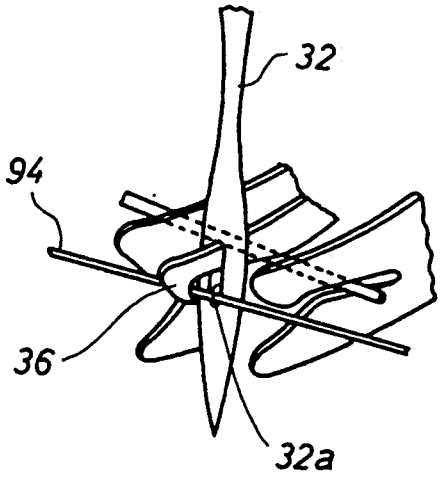
FIG. 4 is a perspective view of a threading hook coming through an eye in a needle for the embodiment.

As shown in FIG. 4, the threading hook 36 goes through the eye 32*a* and catches the thread 94. When the pulse motor 84 reverses, the moving board 58 rises. The compression spring 50 exerts tensile force on the actuating rod 42. The actuating rod 42 and the guide slot 46 rise. The actuating pin 40 rotates the threading rod 34 in reverse. The reverse rotation of the threading rod 34 is transmitted through the linkage 38 to the threading hook 36. The threading hook 36 is rotated and drawn from the eye 32*a*. The thread 94 caught in the threading hook 36 is also drawn from the eye 32*a*.

After step S220 executes the above-mentioned threading procedure, or if step S210 determines that the threading switch 104 is not turned on, step S230 determines the threading switch 104 is not turned on, step S230 determines whether the NP1 arm-shaft phase detector 106 detects that the arm shaft 1 is in its uppermost position and issues the NP1 signal. If at step S230 the NP1 arm-shaft phase detector 106 does not issue the NP1 signal, step S240 drives the sewing-machine motor 114. If at step S230 the NP1 arm-shaft phase detector 106 sends the NP1 signal to the electronic controller 100, step S250 stops the sewing-machine motor 114. Subsequently, step S260 energizes the solenoid 90 so that the stopper 88 protrudes against the force of the coil spring 92, and stops the solenoid 90 to disengage the stopper 88 from the coil spring 92.

Through the processes from step S230 through S260, the needle bar 10 is put in its uppermost position, and the click 18 is almost engaged in the groove 12. After the click 18 is firmly engaged in the groove 12, the needle bar 10 is kept in its upper position.

Subsequently, when at step S270 the operator confirms that the start-stop switch 102 is turned on, step S280 determines whether the presser-foot detecting switch 110 is turned on and the presser-foot is lowered. If at step S280 the presser-foot detecting switch 110 is turned on, step S290 determines whether pattern-sewing operation is instructed or not. If at step S290 a pattern-sewing key (not shown) is operated and the pattern-sewing operation is instructed, step S300 executes pattern-sewing procedure in response to the instruction of the pattern-sewing key and according to pattern program stored in advance. If at step S290 the pattern-sewing key is not operated, step S310 determines whether basting operation is instructed. If at step S310 the basting operation is instructed, step S320 executes the basting procedure according to basting program stored in advance.

Unless the start-stop switch 102 is turned on or the presser-foot detecting switch 110 is turned on, processes of and after step S290 are skipped and the process ends.

Figure 9:
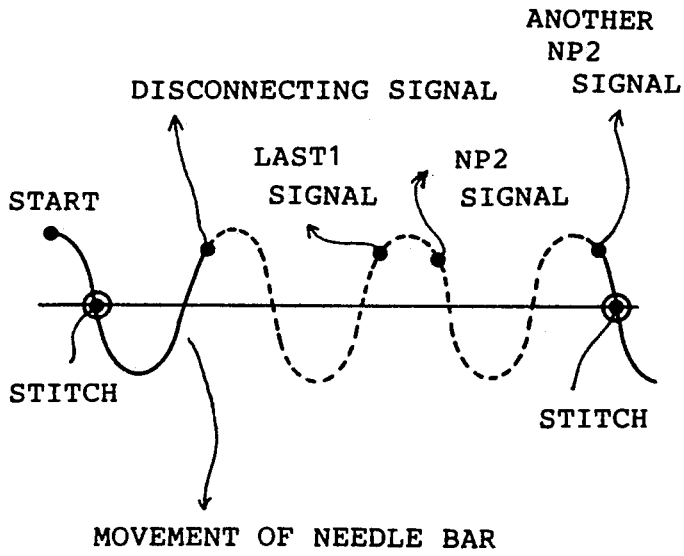
FIG. 9 illustrates the relationship between needle-bar movement and each signal for the embodiment.
Figure 7:
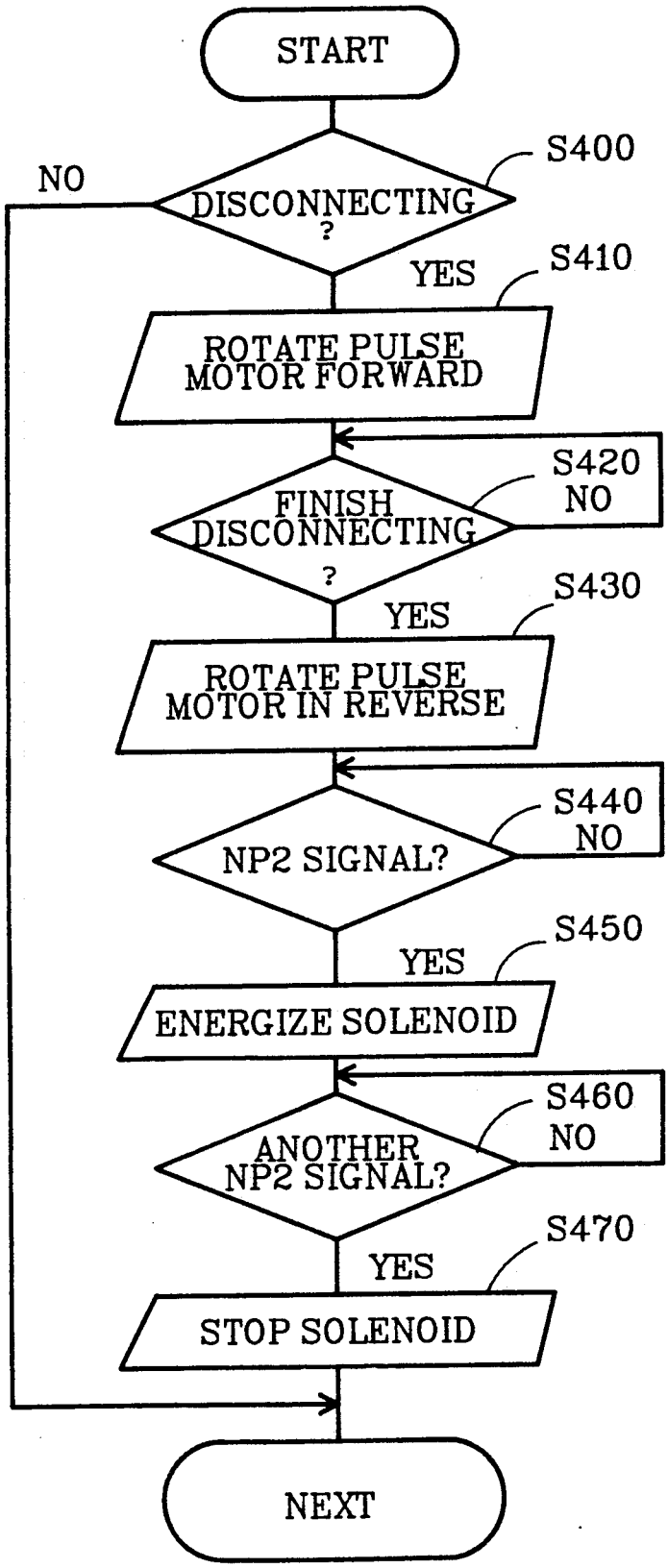
FIG. 7 is a flow chart of needle-bar disconnecting routine executed in the control circuit for the embodiment.

When stitches are skipped without being sewn in the course of the pattern sewing and the basting, the vertical movement of the needle bar 10 is interrupted through needle-bar disconnecting procedure under the control of the electronic controller 100. The needle-bar disconnecting procedure will now be explained with reference to FIGS. 7 and 9.

First, step S400 determines according to disconnecting signal stored in advance in the pattern program and the basting program whether the disconnecting of the needle bar 10 from the needle-bar connecting stud 8 is executed or not. If step S400 determines that the disconnecting is executed, step S410 rotates the pulse motor 84 according to the pulses from the pulse-motor driver 112.

Therefore, as aforementioned, the moving board 58 lowers by the predetermined distance L. As shown in FIG. 8, the disconnecting pin 66 presses down the ridge 76 of the disconnecting board 72 and the disconnecting board 72 is rotated, thereby raising the pin 20 of the click 18. The click 18 is usually raised and lowered through the rotation of the arm shaft 1. The click 18 is thus disengaged from the groove 12. The needle bar 10 is raised by means of the force of the spring 55 until the upper end of the needle bar 10 touches the stopper 88. In this embodiment, when the click 18 is off the groove 12, the needle bar 10 is higher by the gap S than its uppermost position to which the needle bar 10 is raised through the rotation of the arm shaft 1. If the needle-bar connecting stud 8 returns to its uppermost position through the rotation of the upper shaft 1, the click 18 fails to engage in the groove 12. As shown by a broken line in FIG. 9, even if the needle-bar connecting stud 8 rises up and down through the rotation of the arm shaft 1, the needle bar 10 fails to rise.

As aforementioned, when the needle bar 10 is disconnected from the needle-bar connecting stud 8, fabric is fed without being sewed. Subsequently, step S420 determines whether to finish disconnecting the needle bar 10 from the needle-bar connecting stud 8 according to LAST1 signal corresponding to program stored in advance. If at step S420 the LAST1 signal is issued, step S430, contrary to step S410, sends pulses to the pulse motor 84, thereby rotating the pulse motor 84 in reverse.

Specifically, when the pulse motor 84 reverses, the moving board 58 rises. The disconnecting pin 66 is detached from the ridge 76 of the disconnecting board 72. The disconnecting board 72 is rotated through the force of the torsion spring 74, and disengaged from the pin 20.

Subsequently, step S440 determines whether the NP2 signal is issued or not. If at step S440 the NP2 signal is issued, step S450 energizes the solenoid 90, thus thrusting the stopper 88 and lowering the needle bar 10 by the gap S. On the other hand, the needle-bar connecting stud 8 slides up and down the needle bar 10 according to the rotation of the arm shaft 1. When the needle-bar connecting stud 8 slides up close to its uppermost position, the click 18 lowers by the force of the torsion spring 22. The click 18 thus engages in the groove 12. The needle bar 10 is connected to the needle-bar connecting stud 8. The rotation of the arm shaft 1 is transmitted to the needle bar 10, and as shown by a solid line in FIG. 9 the needle bar 10 moves up and down.

Step S460 determines whether another NP2 signal is issued or not. If at step S460 the NP2 signal is issued, step S470 stops the solenoid 90 and the process ends. From the time the first NP2 signal is issued until another NP2 signal is issued, the arm shaft 1 rotates once and the needle-bar connecting stud 8 moves up and down once. During the time period between the NP2 signals, since the solenoid 90 is energized, the click 18 as well as the needle bar 10 are lowered to such a position that the click 18 can engage in the groove 12. By raising the needle-bar connecting stud 8, the click 18 is firmly engaged in the groove 12.

Solenoid 90 need not be provided, in which case the stopper 88 is secured to such a position that the gap S is zero. In this structure, by stopping the moving board 58 where the disconnecting pin 66 rotates the disconnecting board 72, the click 18 is disengaged from the groove 12.

In this embodiment, the moving board 58 lowers by the predetermined distance L, the disconnecting board 72 rotates the click 18, the click 18 is disengaged from the groove 12, and the needle bar 10 is thus disconnected from the needle-bar connecting stud 8. The moving board 58 further lowers, the actuating rod 42 also lowers itself and the threading rod 34, the threading rod 34 rotates, and the threading hook 36 is put through the eye 32*a* in the needle 32.

Specifically, when the moving board 58 lowers by the predetermined distance L, the needle bar 10 disengages from the needle-bar connecting stud 8. While the needle bar 10 is disengaged in the course of the pattern-sewing operation or the basting operation, stitches are skipped. When the moving board 58 further lowers, the threading mechanism 33 threads the eye 32*a* in the needle 32. Through the pulse motor 84 the needle bar 10 can be firmly disconnected from the needle-bar connecting stud 8 and the needle 32 can be threaded. For both the disconnecting operation and the threading operation, only the pulse motor 84 need be controlled. Therefore, the control circuit is simplified, and the threading mechanism as well as the disconnecting mechanism can be compact. While the needle bar 10 is rising without rotating, the needle bar 10 can disengage from the needle-bar connecting stud 8 without doing damage to the fabric. The pattern-sewing operation as well as the basting operation can be smoothly carried out.

To disconnect the needle bar 10 from the needle-bar connecting stud 8, the moving board 58 moves the predetermined distance L, but the actuating rod 42 does not lower although the pulse motor 84 is used in common for the disconnecting operation and the threading operation. Consequently, the operator never feels that improper operation is carried out. The needle bar 10 can be disconnected from the needle-bar connecting stud 8 in time before the threading hook 36 enters the eye 32*a*. The predetermined distance L can be between the start point of the moving board 58 and the point where the threading hook 36 is put through the eye 32*a*. The actuating rod 42 may lower, which causes no substantial problem.

This invention has been described above with reference to the preferred embodiment. Modifications and alterations may become apparent to one skilled in the art upon reading and understanding the specification. It is intended to include all such modifications and alterations within the scope of the appended claims.

What is claimed is:

1. A clutch for a sewing machine having a needle bar movably mounted on a frame of the sewing machine, a needle attached to one end of the needle bar, and a sewing transmission for moving the needle bar, the clutch comprising:

a needle bar connecting stud connected to the sewing transmission and slidably mounted on the needle bar such that the needle bar connecting stud may move in either direction along an axis of the needle bar;

click means attached to the needle bar for selectively attaching the needle bar connecting stud to or detaching the needle bar connecting stud from the needle bar;

disconnecting means for operating the click means to detach the needle bar connecting stud from the needle bar when the disconnecting means rotates in a disconnecting direction; and drive means for moving a drive board relative to the needle bar along a line parallel to the needle bar, where, when the drive means moves the drive board along the line towards the needle, the drive board contacts the disconnecting means and causes the disconnecting means to rotate in the disconnecting direction.

2. The clutch of claim 1, further comprising:

stop means attached to the frame along the needle bar axis; and a resilient retracting member attached between the frame and the needle bar for exerting a force on the needle bar away from the needle; wherein the needle bar is mounted on the frame such that the needle bar moves along the needle bar axis between a needle bar clutch position, in which a distal end of the needle bar away from the needle contacts the stop means, and a top sewing position, in which the distal end is a predetermined clutch distance away from the stop means; and when the click means detaches the needle bar connecting stud from the needle bar, the retracting member forces the needle bar from the top sewing position to the clutch position.

3. The clutch of claim 2, further comprising actuator means for moving the needle bar from the clutch position to the top sewing position to connect the needle bar connecting stud to the needle bar.

4. The clutch of claim 1, in which the disconnecting means comprises a disconnecting board rotatable about a first axis parallel to the needle bar axis, where movement of the drive board towards the needle causes a first end of the disconnecting board to rotate about the first axis in the disconnecting direction such that a second end of the disconnecting board contacts the click means to disconnect the needle bar connecting stud from the needle bar.

5. The clutch of claim 1, in which:

a groove is formed on the needle bar connecting stud; and the click means comprises a click rotatably attached to the needle bar such that the click engages the groove when the click means connects the needle bar connecting stud to the needle bar.

6. The clutch of claim 4, in which:

a ridge extends from the first end of the disconnecting board;

a disconnecting pin extends from the drive board; and a clutch pin extends from the click means; wherein when the drive means moves the drive board towards the needle, the disconnecting pin contacts the ridge causing the disconnecting board to rotate about the second axis such that the second end of the disconnecting board contacts and moves the clutch pin, thereby moving the click means to disconnect the needle bar connecting stud from the needle bar.

7. The clutch of claim 6, in which the ridge comprises:

a disconnecting surface; and a first surface adjacent to the disconnecting surface; wherein the first surface is oblique to the direction of travel of the disconnecting pin, the disconnecting surface is parallel to the direction of travel of the disconnecting pin, and the disconnecting pin contacts the first surface and then the disconnecting surface when the drive means moves the drive board towards the needle.

8. The clutch of claim 7, in which the ridge further comprises a second surface adjacent to the disconnecting surface, where the second surface is oblique to the direction of travel of the disconnecting pin, the disconnecting surface is parallel to the direction of travel of the disconnecting pin, and the disconnecting pin contacts the second surface and then the disconnecting surface when the drive means moves the drive board away from the needle.

9. The clutch of claim 4, in which the disconnecting means further comprises a resilient rotating member mounted on the disconnecting board such that the rotating member applies a force on the disconnecting board to rotate the disconnecting board about the first axis in a direction opposite to the disconnecting direction.

10. The clutch of claim 5, in which the click means further comprises a resilient forcing means attached to the needle bar for forcing the click to rotate towards the position in which the click engages the groove.

11. A clutch and threading apparatus for a sewing machine having a needle bar movably mounted on a frame of the sewing machine, a needle attached to one end of the needle bar, and a sewing transmission for moving the needle bar, the clutch and threading apparatus comprising:

a needle bar connecting stud connected to the sewing transmission and slidably mounted on the needle bar such that the needle bar connecting stud may move in either direction along an axis of the needle bar;

click means attached to the needle bar for selectively connecting the needle bar connecting stud to or disconnecting the needle bar connecting stud from the needle bar;

a threading rod mounted such that the threading rod is movable relative to the needle bar along a first axis parallel to the needle bar axis;

threading means mounted on the threading rod for threading the needle when a threading hook attached to the threading rod is in a threading position adjacent to the needle;

disconnecting means for operating the click means to disconnect the needle bar connecting stud from the needle bar when the disconnecting means rotates in a disconnecting direction about an axis parallel to the needle bar axis; and drive means for moving a drive board relative to the needle bar in a line parallel to the needle bar axis, wherein;

when the drive means moves the drive board towards the threading position, the drive board contacts the threading means to move the threading means and threading rod into the threading position; and when the drive means moves the drive board towards the threading position, the drive board contacts the disconnecting means to rotate the disconnecting means in the disconnecting direction.

12. The clutch and threading apparatus of claim 11, further comprising:

stop means attached to the frame along the needle bar axis; and a resilient retracting member attached between the frame and the needle bar for exerting a force on the needle bar away from the needle; wherein the needle bar is mounted on the frame such that the needle bar moves along the needle bar axis between a needle bar clutch position in which a distal end of the needle bar away from the needle contacts the stop means and a top sewing position in which the distal end is a predetermined clutch distance away from the stop means; and when the click means detaches the needle bar connecting stud from the needle bar, the retracting member forces the needle bar from the top sewing position to the clutch position.

13. The clutch and threading apparatus of claim 12, further comprising actuator means for moving the needle bar from the clutch position to the top sewing position to connect the needle bar connecting stud to the needle bar.

14. The clutch and threading apparatus of claim 11, in which the disconnecting means comprises a disconnecting board rotatable about a second axis parallel to the needle bar axis, where movement of the drive board towards the threading position causes a first end of the disconnecting board to rotate about the second axis in a disconnecting direction such that a second end of the disconnecting board contacts the click means to disconnect the needle bar connecting stud from the needle bar.

15. The clutch and threading apparatus of claim 14, in which:

a groove is formed on the needle bar connecting stud; and the click means comprises a click rotatably attached to the needle bar such that the click engages the groove when the click means connects the needle bar connecting stud to the needle bar.

16. The clutch and threading apparatus of claim 14, in which:

a ridge extends from the first end of the disconnecting board;

a disconnecting pin extends from the drive board; and a clutch pin extends from the click means; wherein when the drive means moves the drive board towards the needle, the disconnecting pin contacts the ridge causing the disconnecting board to rotate about the second axis such that the second end of the disconnecting board contacts and moves the clutch pin, thereby moving the click means to disconnect the needle bar connecting stud from the needle bar.

17. The clutch and threading apparatus of claim 16, in which the ridge comprises:

a disconnecting surface; and a first surface adjacent to the disconnecting surface; wherein the first surface is oblique to the direction of travel of the disconnecting pin, the disconnecting surface is parallel to the direction of travel of the disconnecting pin, and the disconnecting pin contacts the first surface and then the disconnecting surface when the drive means moves the drive board towards the needle.

18. The clutch and threading apparatus of claim 17, in which the ridge further comprises a second surface adjacent to the disconnecting surface, where the second surface is oblique to the direction of travel of the disconnecting pin, the disconnecting surface is parallel to the direction of travel of the disconnecting pin, and the disconnecting pin contacts the second surface and then the disconnecting surface when the drive means moves the drive board away from the needle.

19. The clutch of claim 14, in which the disconnecting means further comprises a resilient rotating member mounted on the disconnecting board such that the rotating member applies a force on the disconnecting board to rotate the disconnecting board about the first axis in a direction opposite to the disconnecting direction.

20. The clutch and threading apparatus of claim 11, in which the threading means comprises:

threading hook extending means attached to a first end of the threading rod for extending the threading hook when the threading rod rotates about the threading rod axis; and actuating means mounted on a second end of the threading rod for rotating the threading rod about the threading rod axis when the threading rod is in the threading position.

21. The clutch and threading apparatus of claim 20, further comprising stop means mounted on the needle bar for stopping the threading rod when the threading rod is in the threading position.

22. The clutch of claim 15, in which the click means further comprises a resilient forcing means attached to the needle bar for forcing the click to rotate towards the position in which the click engages the groove.

23. A clutch and threading apparatus for a sewing machine having a needle bar movably mounted on a frame of the sewing machine, a needle attached to one end of the needle bar, and a sewing transmission for moving the needle bar, the clutch and threading apparatus comprising:

a needle bar connecting stud having a groove formed thereon connected to the sewing transmission and slidably mounted on the needle bar such that the needle bar connecting stud may move in either direction along an axis of the needle bar;

click means attached to the needle bar for selectively connecting the needle bar connecting stud to or disconnecting the needle bar connecting stud from the needle bar, where the click means comprises a click rotatably attached to the needle bar such that the click engages the groove when the click means connects the needle bar connecting stud to the needle bar;

a threading rod mounted such that the threading rod is movable relative to the needle bar along a first axis parallel to the needle bar axis;

threading means mounted on the threading rod for threading the needle when a threading hook attached to the threading rod is in a threading position adjacent to the needle;

disconnecting means for operating the click means to disconnect the needle bar connecting stud from the needle bar when the disconnecting means rotates in a disconnecting direction about an axis parallel to the needle bar axis; and drive means for moving a drive board relative to the needle bar in a line parallel to the needle bar axis, where when the drive means moves the drive board towards the threading position, the drive board contacts the threading means to move the threading means and threading rod into the threading position and the disconnecting means to rotate the disconnecting means in the disconnecting direction;

stop means attached to the frame along the needle bar axis;

a resilient retracting member attached between the frame and the needle bar for exerting a force on the needle bar away from the needle; and actuator means for moving the needle bar from the clutch position to the top sewing position; wherein the needle bar is mounted on the frame such that the needle bar moves along the needle bar axis between a needle bar clutch position in which a distal end of the needle bar away from the needle contacts the stop means and a top sewing position in which the distal end is a predetermined clutch distance away from the stop means; and when the click means detaches the needle bar connecting stud from the needle bar, the retracting member forces the needle bar from the top sewing position to the clutch position.

24. The clutch and threading apparatus of claim 23, in which the disconnecting means comprises a disconnecting board rotatable about a second axis parallel to the needle bar axis, where movement of the drive board towards the threading position causes a first end of the disconnecting board to rotate about the second axis in a disconnecting direction such that a second end of the disconnecting board contacts the click means to disconnect the needle bar connecting stud from the needle bar.

25. The clutch of claim 24, in which:

a ridge extends from the first end of the disconnecting board, the ridge comprising a disconnecting surface; and a first and surfaces adjacent to the disconnecting surface; and the first and second surfaces are oblique to the direction of travel of the disconnecting pin and the disconnecting surface is parallel to the direction of travel of the disconnecting pin, wherein the disconnecting pin contacts the first surface and then the disconnecting surface when the drive means moves the drive board towards the needle, and the disconnecting pin contacts the second surface and then the disconnecting surface when the drive means moves the drive board away from the needle;

a disconnecting pin extends from the drive board; and a clutch pin extends from the click means; wherein when the drive means moves the drive board towards the needle, the disconnecting pin contacts the first disconnecting surface of the ridge causing the disconnecting board to rotate about the second axis such that the second end of the disconnecting board contacts and moves the clutch pin, thereby moving the click means to disconnect the needle bar connecting stud from the needle bar.

* * * * *